US005178918A

United States Patent [19]

Duva et al.

[11] Patent Number: 5,178,918

[45] Date of Patent: Jan. 12, 1993

[54] ELECTROLESS PLATING PROCESS

[76] Inventors: Robert Duva, 646 Terrace Dr., Paramus, N.J. 07652; George Ondecker, 103 Deerfield Rd., West Caldwell, N.J. 07006

[21] Appl. No.: 759,504

[22] Filed: Sep. 13, 1991

Related U.S. Application Data

[63] Continuation-in-part of Ser. No. 238,976, Aug. 25, 1988, abandoned, which is a continuation-in-part of Ser. No. 885,426, Jul. 14, 1986, abandoned.

[51] Int. Cl.[5] ..... C23C 26/00

[52] U.S. Cl. ..... 427/443.1; 427/436; 427/437; 106/1.23

[58] Field of Search ..... 427/443.1, 436, 437; 106/1.23

[56] References Cited

U.S. PATENT DOCUMENTS

| | | | |
|---|---|---|---|
| 3,396,042 | 8/1968 | Duva | 106/1.23 |
| 3,700,469 | 10/1972 | Okinaka | 427/437 |
| 3,798,056 | 3/1974 | Okinaka | 204/212 |
| 3,862,850 | 1/1975 | Trueblood | 427/437 |
| 4,091,128 | 5/1978 | Franz | 427/443.1 |
| 4,162,337 | 7/1979 | DAsaro | 106/1.23 |
| 4,337,091 | 6/1982 | El-Shazly | 427/437 |
| 4,352,690 | 10/1982 | Dettke | 427/443.1 |
| 4,374,876 | 2/1983 | El-Shazly | 427/443.1 |
| 4,474,838 | 10/1984 | Halecky | 427/436 |
| 4,481,035 | 11/1984 | Andrarcek | 427/443.1 |

FOREIGN PATENT DOCUMENTS

| | | | |
|---|---|---|---|
| 272100 | 6/1988 | European Pat. Off. | 427/443.1 |

OTHER PUBLICATIONS

J. C. Bailar et al. "Comprehensive Inorganic Chemistry" Pergamon Press, 1973, pp. 148–150.

*Primary Examiner*—Shrive Beck
*Assistant Examiner*—Vi Duong Dang
*Attorney, Agent, or Firm*—Ostrolenk, Faber, Gerb & Soffen

[57] ABSTRACT

Deposition of gold without the use of electric current is described. The system produces thick gold films without the use of strong reducing agents. Discontinuous land areas on high reliability printed wiring boards or ceramic circuits can be readily coated with gold to any desired thickness. Long lead glass-to-metal seals can be uniformly plated without distortion of the leads.

21 Claims, No Drawings

ELECTROLESS PLATING PROCESS

This is a continuation in part of U.S. patent application Ser. No. 238,976, filed Aug. 25, 1988, which is a continuation of Ser. No. 885,426, filed Jul. 14, 1986, both now abandoned.

BACKGROUND OF THE INVENTION

This invention relates to an electroless plating process and formulations and, more particularly, to an electroless plating process for depositing gold on a substrate with a formulation that has such stability that spontaneous deposition cannot occur.

In the processing of electronic components, electroless gold has been used to achieve uniform metal distribution as well as deposition onto areas that are not in contact electrically.

Much has been described in literature comparing immersion (or displacement) processes with electroless (or autocatalytic) techniques. In summary, immersion systems will produce a maximum coating thickness of about ¼ to ½ micrometer whereas electroless systems have no limit to thickness except that which is practical—for gold, about 2 to 4 micrometers.

The prior art discloses many processes for the production of gold coatings to appreciable thicknesses; the outstanding two are:

1) U.S. Pat. No. 3,396,042—catalytic reduction and
2) U.S. Pat. No. 3,798,056—borohydride reduction.

Although these processes can produce satisfactory gold deposits, they are unstable for long term production in high volume manufacturing operations. The stability of the gold complex is lowered by the chemistry utilized and total system decomposition occurs.

SUMMARY OF THE INVENTION

The invention describes a chemical process which, when used in accordance with the prescribed operating parameters, will produce a gold coating to any practical thickness for use in the electronics industry. The process has such stability that spontaneous decomposition cannot occur.

DESCRIPTION

This invention is based on the fact that gold is a highly electronegative element and wishes to remain in the reduced state of elemental gold rather than staying in an ionic form. Because it is easily reduced, strong reducing agents such as hypophosphites, hydrazines, borohydrides, boranes will and do cause rapid deterioration and decomposition of the gold compound used. Elimination of these harsh reducers and the substitution for them with mild reducers/complexers has produced a system which is extremely stable and which still yields a controlled reduction of gold for functional use within the electronics industry.

The solution of the invention is made with potassium gold cyanide, potassium cyanide, potassium hydroxide and the potassium salts of weak stable organic or amino acids. At times, additions of pH stabilizers will be needed as buffers to maintain correct pH control. The examples given below will give some further detail as to chemical and physical operation of the solution.

EXAMPLE 1

A solution was made with the following materials:

| | |
|---|---|
| Gold as potassium gold cyanide | 5 g/L |
| Potassium hydroxide | 100 g/L |
| Potassium cyanide | 0.5 g/L |
| Nitrilotriacetic acid | 80 g/L |

Operating parameters for the above are:

| | |
|---|---|
| pH | 13.5 |
| Temperature | 100° C. |
| Agitation | vigorous |

Tribasic potassium phosphate was added to maintain the pH at or about 13.5.

A ceramic substrate metallized with tungsten was activated and placed in the above solution for 40 min. A coating thickness of 2.5 micrometers of gold resulted. At a lower temperature, i.e. 70° C., only ½ micrometer of gold was deposited in 40 minutes.

EXAMPLE 2

A solution was made of the following materials:

| | |
|---|---|
| Gold as potassium gold cyanide | 8 g/L |
| Potassium hydroxide | 150 g/L |
| Potassium cyanide | 2 g/L |
| Ethylenediammine tetraacetic acid | 60 g/L |

Operating parameters for the above are:

| | |
|---|---|
| pH | 13.0 |
| Temperature | 102° C. |
| Agitation | vigorous |

Cyclohexylamine was added as a pH stabilizer.

A multi-layer printed wiring board which had been copper thru-hole plated and then coated with electroless nickel was activated and placed in the above solution for 30 minutes. Gold thickness obtained was 2 micrometers.

EXAMPLE 3

A solution was made of the following materials:

| | |
|---|---|
| Gold as potassium gold cyanide | 10 g/L |
| Potassium hydroxide | 120 g/L |
| Potassium cyanide | 5 g/L |
| Citric acid | 50 g/L |

Operating parameters for the above are:

| | |
|---|---|
| pH | 13.5 |
| Temperature | 101° C. |
| Agitation | vigorous |

Cyclohexylamine was added as a pH stabilizer. Five hundred diode bases with 2 inch nickel-iron leads were cleaned and activated and then immersed in the above solution for 15 minutes. A gold thickness of one micrometer was obtained.

EXAMPLE 4

A solution was made of the following material:

| | |
|---|---|
| Gold as potassium gold cyanide | 4 g/L |
| Potassium hydroxide | 20 g/L |
| Potassium cyanide | 1 g/L |
| Nitrilotriacetic acid | 80 g/L |

Operating parameters for the above are:

| | |
|---|---|
| pH | 4.0 |
| Temperature | 100° C. |
| Agitation | moderate |

Potassium phosphate was added as a pH stabilizer.

Five hundred diode bases with 2 inch nickel-iron leads were cleaned and activated and immersed in the above solution for 5 minutes. A gold coating of about ¼ micrometer was obtained. These parts were then immersed into the solution described in Example (3) for 15 minutes. An additional 1 micrometer of gold thickness was deposited.

EXAMPLE 5

A solution was made of the following materials:

| | |
|---|---|
| Gold as potassium gold cyanide | 2 g/L |
| Potassium hydroxide | 100 g/L |
| Potassium cyanide | 2 g/L |
| Hexaethylenepentamine triacetic acid | 40 g/L |

Operating parameters for the above are:

| | |
|---|---|
| pH | 13.5 |
| Temperature | 102° C. |
| Agitation | vigorous |

Cyclohexylamine was added as a pH stabilizer.

Ceramic substrates metallized with molybdenum-manganese were activated and immersed in the above solution for 1 hour. The gold thickness obtained was 2.8 micrometers.

Please note that in the foregoing examples the amounts of "gold, as potassium gold cyanider" refer to the amount of gold, not the amount of potassium gold cyanide.

Summarizing, the present invention concerns a process and examples of aqueous solutions for electroless plating of gold on a substrate. Two features constitute the key attributes of the present invention. First, the aqueous solution of the present invention does not contain strong reducing agents, e.g., hypophosphites, hydrazines, borohydrides, borides and the like. The reason for this deliberate avoidance of strong reducing agents is that the presence of such agents in an aqueous solution would rapidly deteriorate and decompose this gold compound and thus interfere with the desire of the inventors herein to obtain a "controlled", consistently reproducible releasing of the gold.

Second, the invention provides an aqueous solution which contains potassium cyanide and thus provides an excess amount of free cyanide ions. That is, there are always enough cyanide ions left over to assure the continuous availability thereof in the solution. The inventors have found that this second attribute obtains a system which is extremely stable and which results in a very controlled gold reduction rate. Actually, the provision of an excess amount of free cyanide ions improves the reaction mechanism in that it provides a constant deposition rate of the gold on the substrate and obtains more uniform and better adhering coats of gold. Also, the free cyanide ions act as a complexing agent for base metal contaminants which are present in the solution during use. This allows the process and formulations of the present invention to deliver to the trade a method and an aqueous solution which provides very consistent and highly efficient electroless plating of gold.

The conventional approach was to provide an excess amount of free cyanide ions only in solutions containing strong reducing agents to prevent the previously mentioned deleterious and spontaneous, uncontrolled decomposition of gold. But the prior art never deemed it necessary or worthwhile to provide potassium cyanide, i.e. an excess amount of free cyanide ions, in solutions which are free of strong reducing agents.

Again, the potassium cyanide is maintained in the solution of the present invention in an amount which assures the continuous availability of an excess amount of free cyanide ions in the solution during the immersion of the substrate, whereby the solution is effective to deposit gold on the substrate at a controllable rate.

As would be readily apparent to one examining the examples given above, the potassium cyanide does not react chemically and therefore, inherently, free potassium cyanide ions will be available in the solution. It should also be apparent at a glance from examples 1, 2, 3 and 5 that the solutions are alkaline, each having a pH equal or greater than 13.0. The one example of an acid solution (example 4) produces an unacceptably thin gold coating of about ¼ micrometer and requires that the parts be subsequently immersed into the solution of example 3 to obtain the benefits of the present invention. In the alkaline solutions of the present invention, even a minimum of 0.1 g/L potassium cyanide concentration will not deplete spontaneously.

Tests have shown that, to obtain commercially satisfactory releasing of gold on a substrate at a controllable rate, at least about 0.5 g/L of excess free cyanide ions should be in the solution. The lowest limit of potassium cyanide of about 0.1 g/L represents an absolute minimum concentration of free cyanide ions. At this minimum concentration of cyanide ions, the operation of the bath is quite marginal and, practically speaking, unsuited for industrial applications. However, a concentration of less than about 0.1 g/L would be totally unworkable for the purposes of obtaining "controlled" releasing of gold on the substrate with the solutions of the present invention.

By way of general background, it is worth noting that there are several methods of applying a metallic coating to a substrate which do not require the application of an outside source of electric current and which are closely enough related to be classified together. These are contact plating, immersion plating and autocatalytic or "electroless" plating. Contact plating locates within the work an internal galvanic couple, which provides the required flow of electrons. It is an old art, seldom used anymore. In immersion plating (also called displacement deposition) the work is less noble than the metal in solution; the dissolved metal deposits on the work.

The third technique is the technique of the present invention which involves autocatalytic or electroless plating, in which the deposited metal is reduced from its ionic state in solution by means of a chemical reducing agent rather than by an electric current. Autocatalytic plating as used herein may be defined as "deposition of a metallic coating by controlled chemical reduction that is catalyzed by the metal or alloy being deposited". The process provides a continuous buildup of the metal or alloy coating on a suitable substrate by simple immersion in an appropriate aqueous solution; a chemical reducing agent in the solution supplying the electrons for the underlying reaction. The reaction takes place only on a "catalytic" surface. The auto catalytic plating process differs in both its mechanism and its result from:

1. Immersion or displacement plating, which requires no reducing agent in the solution. The electrons are furnished by the substrate itself. The immersion deposition ceases as soon as the substrate is completely covered by the coating, whereas auto catalytic plating knows no limit to the thickness of deposits obtainable.

2. Homogenous chemical reduction processes such as silvering, where deposition occurs indiscriminately over all objects in contact with the solution, and often in the body of the solution itself.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electroless plating process for plating gold on a substrate, the process comprising:

immersing the substrate in an aqueous solution including:

(a) potassium gold cyanide;

(b) potassium hydroxide;

(c) potassium cyanide; and (d) a weak stable organic acid or amino acid and a Ph stabilizer;

maintaining said substrate immersed within said aqueous solution for a period of time sufficient to deposit a desired amount of gold on the substrate; and said solution being effectively free of strong reducing agents and said potassium cyanide being maintained in said solution in an amount providing an excess amount of free cyanide ions in said solution during said immersion of said substrate whereby said solution is effective to controllably deposit gold on said substrate.

2. A process according to claim 1 further comprising maintaining the operating temperature of the solution between 70 and 110 degrees C.

3. A process according to claim 1, further comprising maintaining the operating pH of the solution between 12.5 and 14.0.

4. A processing according to claim 1, wherein the gold concentration is between 1 and 30 grams per liter.

5. A process according to claim 1, wherein the potassium cyanide concentration is between 0.1 and 10 grams per liter.

6. A process according to claim 1 wherein the weak stable organic acid or amino acid concentration is between 0.1 and 200 grams per liter.

7. An electroless plating process for plating gold on a substrate, the process comprising:

immersing the substrate in an aqueous solution including:

(a) potassium gold cyanide;

(b) potassium hydroxide;

(c) potassium cyanide;

(d) a weak stable organic acid or amino acid; and (e) a pH stabilizer, said solution being capable of being operated at the boiling point of the solution without any deterioration or decomposition of system components;

maintaining said substrate immersed within said aqueous solution for a period of time sufficient to deposit a desired amount of gold on the substrate; and said solution being free of strong reducing agents and said potassium cyanide being maintained in said solution in an amount providing an excess amount of free cyanide ions in said solution during said immersion of said substrate whereby said solution is effective to controllably deposit gold on said substrate.

8. A process according to claim 7 further comprising maintaining the operating temperature of the system between 90 and 110 degrees C.

9. A process according to claim 7 further comprising maintaining the operating pH between 12.5 and 14.0.

10. An aqueous solution for the electroless plating of gold on a substrate, the aqueous solution comprising:

potassium gold cyanide;

potassium hydroxide;

potassium cyanide;

a weak stable organic acid or amino acid;

a pH stabilizer; and said solution being effectively free of strong reducing agents and said potassium cyanide being maintained in said solution in an amount providing an excess amount of free cyanide ions in said solution during the immersion of a substrate in said solution whereby said solution is effective for controllably depositing gold on said substrate.

11. An aqueous solution according to claim 10 wherein the operating pH of the solution is between 12.5 and 14.0.

12. An aqueous solution according to claim 10 wherein the gold concentration is between 1 and 30 grams per liter.

13. An aqueous solution according to claim 10, wherein the potassium cyanide concentration is between 0.2 and 10 grams per liter.

14. An aqueous solution according to claim 11, wherein the weak stable organic acid or amino acid concentration is between 0.1 and 200 grams per liter.

15. An electroless plating process for plating gold on a substrate, the process comprising:

immersing the substrate in an aqueous solution including:

(a) potassium gold cyanide;

(b) potassium hydroxide;

(c) potassium cyanide; and (d) a weak stable organic acid or amino acid and a pH stabilizer;

maintaining said substrate immersed within said aqueous solution for a period of time sufficient to deposit a desired amount of gold on the substrate; and said solution being effectively free of strong reducing agents.

16. An electroless plating process for plating gold on a substrate, the process comprising:

immersing the substrate in an aqueous solution including:

(a) potassium gold cyanide;

(b) potassium hydroxide;

(c) potassium cyanide;

(d) a weak stable organic acid or amino acid; and (e) a pH stabilizer, said solution being capable of being operated at the boiling point of the solution without any deterioration or decomposition of system components;

maintaining said substrate immersed within said aqueous solution for a period of time sufficient to deposit a desired amount of gold on the substrate; and said solution being free of strong reducing agents.

17. An aqueous solution for the electroless plating of gold on a substrate, the aqueous solution comprising:

potassium gold cyanide;

potassium hydroxide;

potassium cyanide;

a weak stable organic acid or amino acid;

a pH stabilizer; and said solution being effectively free of strong reducing agents.

18. An aqueous solution according to claim 17, wherein the operating pH of the solution is between 12.5 and 14.0.

19. An aqueous solution according to claim 17 wherein the gold concentration is between 1 and 30 grams per liter.

20. An aqueous solution according to claim 17, wherein the potassium cyanide concentration is between 0.2 and 10 grams per liter.

21. An aqueous solution according to claim 17, wherein the weak stable organic acid or amino acid concentration is between 0.1 and 200 grams per liter.

* * * * *